US007600648B2

(12) United States Patent
Hamer

(10) Patent No.: US 7,600,648 B2
(45) Date of Patent: Oct. 13, 2009

(54) BOTTLE CAP WITH COMBINATION LOCK

(76) Inventor: Douglas Taylor Hamer, 20 Grand Ave., Suite E, Greenville, SC (US) 29607

( * ) Notice: Subject to any disclaimer, the term of this patent is extended or adjusted under 35 U.S.C. 154(b) by 597 days.

(21) Appl. No.: 11/083,294

(22) Filed: Mar. 17, 2005

(65) Prior Publication Data

US 2006/0207958 A1 Sep. 21, 2006

(51) Int. Cl.
*B65D 39/00* (2006.01)
*A61J 1/03* (2006.01)
*E05B 65/00* (2006.01)

(52) U.S. Cl. ..... 215/221; 215/206; 215/228; 70/77

(58) Field of Classification Search ..... 215/206, 215/228, 221, 295, 305; 220/676, 656, 657; 70/163, 164, 166, 167, 171, 158, 244, 246
See application file for complete search history.

(56) References Cited

U.S. PATENT DOCUMENTS 1,687,887 A * 10/1928 Pletcher ..... 220/301
1,811,896 A * 6/1931 Ross ..... 4/619
2,063,678 A * 12/1936 Hulme ..... 215/215
3,850,325 A * 11/1974 MacLeod ..... 215/218
3,901,407 A * 8/1975 Mitchell et al. ..... 220/315
4,722,208 A * 2/1988 Ye ..... 70/312
4,796,768 A 1/1989 Stuckey
4,829,796 A * 5/1989 Kim ..... 70/168
4,848,621 A 7/1989 Radliff
5,212,971 A 5/1993 Yoon et al.
5,317,796 A 6/1994 Hunter
5,351,845 A 10/1994 Hunter
6,059,132 A 5/2000 Benjamin
6,059,135 A 5/2000 James et al.
6,786,346 B1 9/2004 Gurnard et al.
7,055,707 B2 * 6/2006 Yoneyama et al. ..... 215/12.1

* cited by examiner

*Primary Examiner*—Robin Hylton
(74) *Attorney, Agent, or Firm*—John B Hardaway, III; Nexsen Pruet, LLC

(57) ABSTRACT

A locking cap for a container has a combination lock built into the top. Two or more thumbwheels with numbers or letters are mounted beneath the top surface of the cap or gung plugs. The thumb wheels have through holes corresponding to the numbers or letters. One or more pins are slidably mounted in the cap. The pins are locked by the thumb wheels unless the through holes are in alignment. The pins either project through holes in the container or abut inwardly, projecting portions with the top of the container to prevent turning of the cap unless the pins are retracted. Combinations of numbers or letters can be preset at manufacture, or selected at or after sale, using plugs to fill selected through holes.

5 Claims, 14 Drawing Sheets

SECTION A-A

BOTTLE CAP WITH COMBINATION LOCK

FIELD OF THE INVENTION

This invention relates to methods for incorporating a combination lock into a cap for a vial, bottle, jug or drum containing a toxic chemical, a pharmaceutical or any other material that should be secured.

BACKGROUND AND PRIOR ART

Secure caps for containers of various substances are encountered frequently. Automotive and truck fuel tanks employ locking caps to prevent theft of gasoline and diesel fuel. Various designs for child-proofing medicine bottles and cleaning supplies rely on strength and complex manipulation to keep potent medicines and corrosive chemicals out of the mouths of babes.

U.S. Pat. No. 4,796,768 to Stuckey discloses a locking mechanism for a cap based on a clutching mechanism and using a keyed or combination lock.

U.S. Pat. No. 4,848,621 to Radliff discloses a cap for a fuel container in which a key may be hidden.

U.S. Pat. No. 5,212,971 to Yoon et al. discloses a "push button combination lock" to secure a fuel tank.

U.S. Pat. No. 5,317,796 to Hunter discloses child resistant packaging which employs combinations of twists to deter children while still making the contents accessible to adults. U.S. Pat. No. 5,351,845, also to Hunter, discloses another combination style twist-off cap.

U.S. Pat. No. 6,059,132 to Benjamin is directed to a combination lock cap for a threaded bottle.

U.S. Pat. No. 6,059,135 to James et al. is directed to a compartmentalized "lunch pail" with a combination lock in the lid and sliding bolt type latching system.

U.S. Pat. No. 6,786,346 to Gurnard et al. is directed to a locking cap for a drinking glass using a wire to pull a castellated skirt portion under a lip and to release the wire when a correct combination is put into the wire latching area.

The prior are safety caps are complicated and are not readily adapted to common sized containers such as the ubiquitous amber bottles or vials identified with pharmacies prescription filling or other common bottles for household cleaners.

BRIEF DESCRIPTION OF THE INVENTION

It is a first objective of this invention to provide a locking cap for a vial or bottle which includes a combination lock. It is a second object of this invention to provide a cap for a vial or jar which can be transferred from one vial, bottle or drum to another. It is a further objective of this invention to provide a system whereby a person may have multiple caps with the same combination.

These and other objects of this invention are obtained by a locking cap having a brace of pins slideable through a set of three numbered wheels with holes which, when properly aligned, allow the pins to pass through the wheels. When the pins are in an extended position, blocked by the wheels, the pins lock the cap in place on a vial or container by being positioned under an inner lip against an inward projection in the side of the container or through a brace of holes in the side of the vial or bottle. The pins may be joined at their periphery to form a plug or blocking lock to impact a projection.

DETAILED DESCRIPTION OF THE INVENTION

A combination lock type cap for a vial, bottle or other container serves many functions. Safety is a primary concern when expensive medicine such as erythropoietin, huGMCSF and remicade are used outside (or even inside) an hospital setting. Safety is also a concern when medicines are used in nursing homes, or in dwelling houses where children are present. Security is also a concern with potent morphine analogues that are subject to abuse by persons for whom they have not been prescribed. Common household chemicals such as NaOCl, NaOH and paint thinners pose serious risks to the uninformed, especially children. Garden chemicals such as lime and a few pesticides may cause injury to eyes, or if consumed, poisoning, Fuels such as gasoline, diesel fuel and charcoal lighter fluid should be kept from children and are sometimes stolen in bulk.

The invention is a locking system applicable to a wide range of the above listed products which has a cost which can be justified in consideration of the value of the protected property and protected parties. The locking cap of this invention may be made in a limited number of standard sizes and used over a wide range of products.

FIGS. 1-6 illustrate a first embodiment of the invention wherein the locking cap is used on a standard medicine vial in which prescription drugs are usually packaged by a commercial pharmacy.

Figure 1:
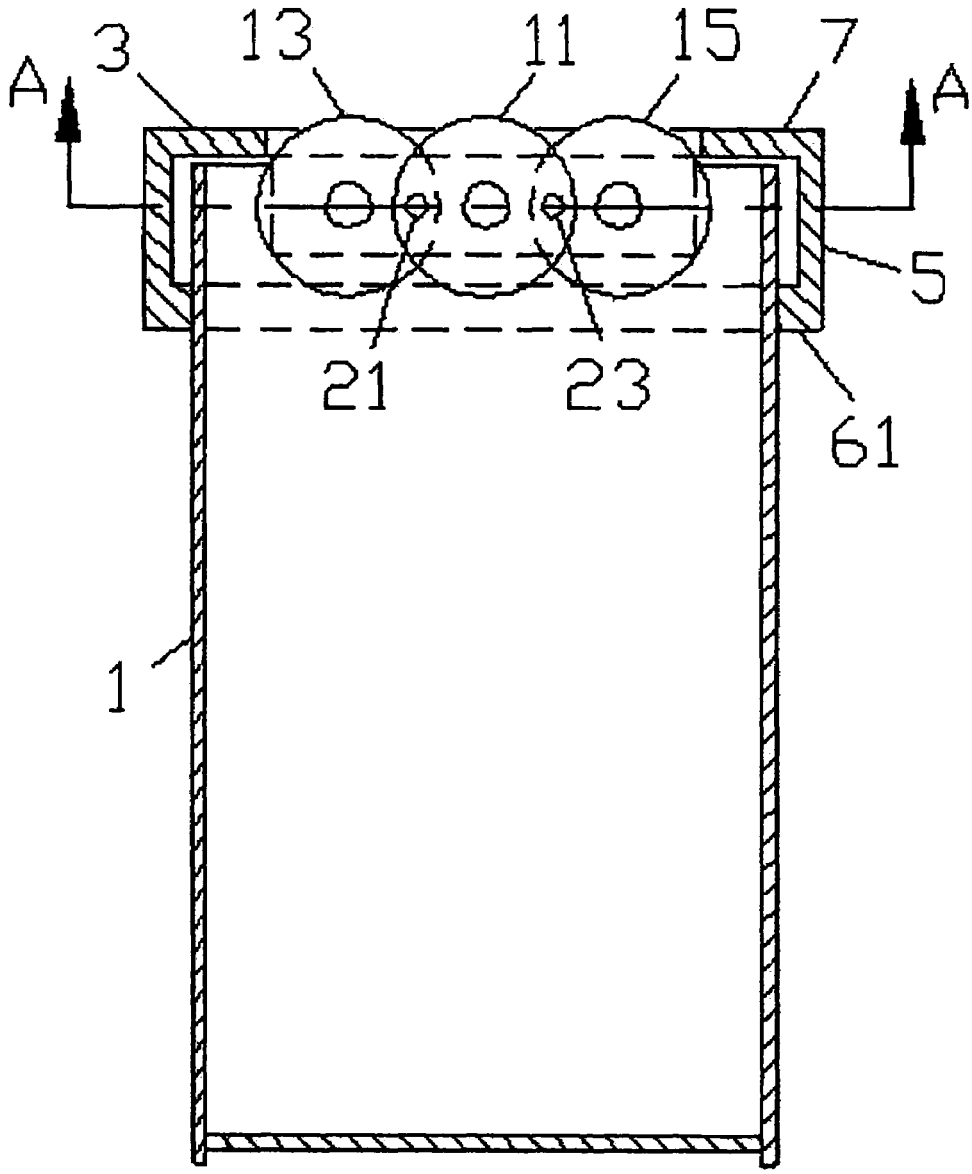
FIG. 1 is a first side elevation of a locking cap on a vial.

FIG. 1 is a side elevation of a vial and cap. Vial 1 has affixed a cap 3 having a circular side 5 or skirt and a substantially flat top 7. A small inward projection at the base of the shirt may engage a lip of the vial as is conventional in medicine vials. Three finger wheels 11, 13 and 15 are mounted within the cap. A front wheel 11 and back wheels 13 and 15 are aligned on parallel axes, preferably in the same plane such that wheels 13 and 15 partially overlap wheel 11. Wheel 11 has two holes 21, 23 through the wheel which can be aligned with at least one hole in each of wheels 13 and 15 (not shown in this view). Passage of a pin through two wheels by each pin is required to unlock the device by sliding the pin(s).

Figure 2:
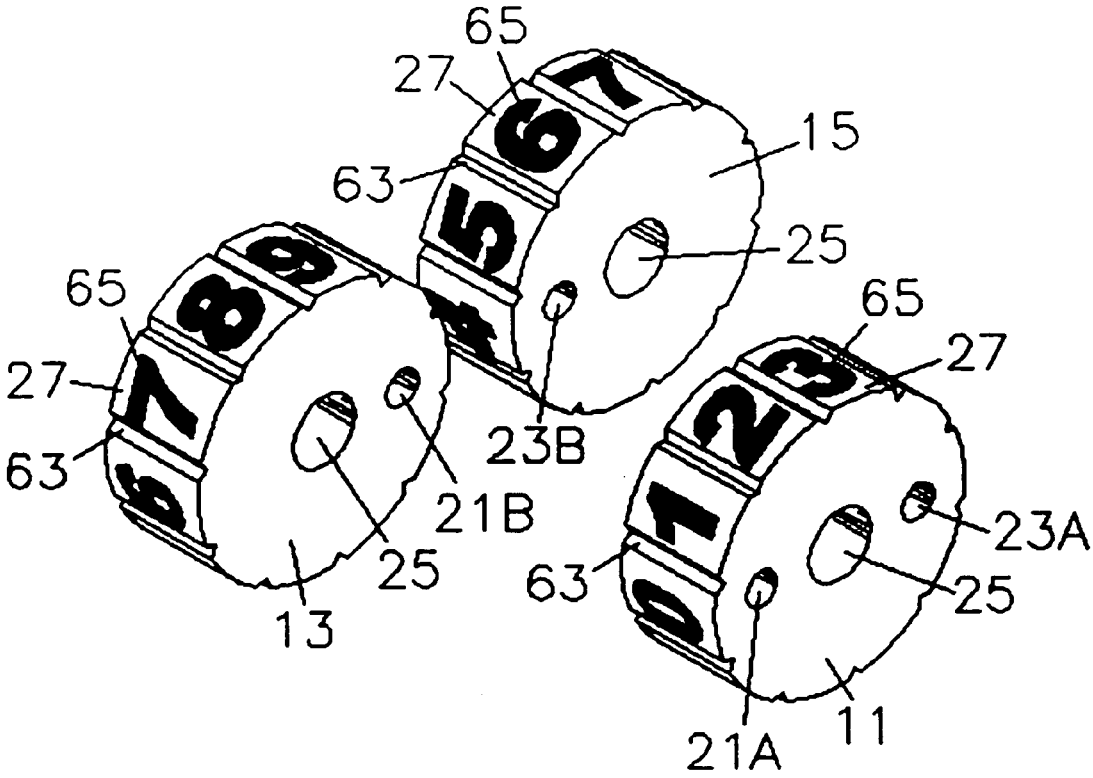
FIG. 2 is a perspective of a finger wheel.

Finger wheels 11, 13, 15 are shown in perspective in FIG. 2. A hole 25 in the center serves as a race for an axle (not shown). Holes 21A, and 23A are located on a circle radially outward of hole 25. On finger wheel 11, two holes 21B and 23B are required and they are preferably at 180°. On finger wheels 13 and 15 one or two holes may be present but one is preferred. Outer surface 27 carries numbers 65 and is preferably knurled (63).

The number of Arabic numbers 65 or other indicia (letters, astrological symbols, etc.) are not strictly limited except that when the three wheels are aligned so that the holes are in register, a number or other indicium should be at top dead center of each wheel.

Figure 3:
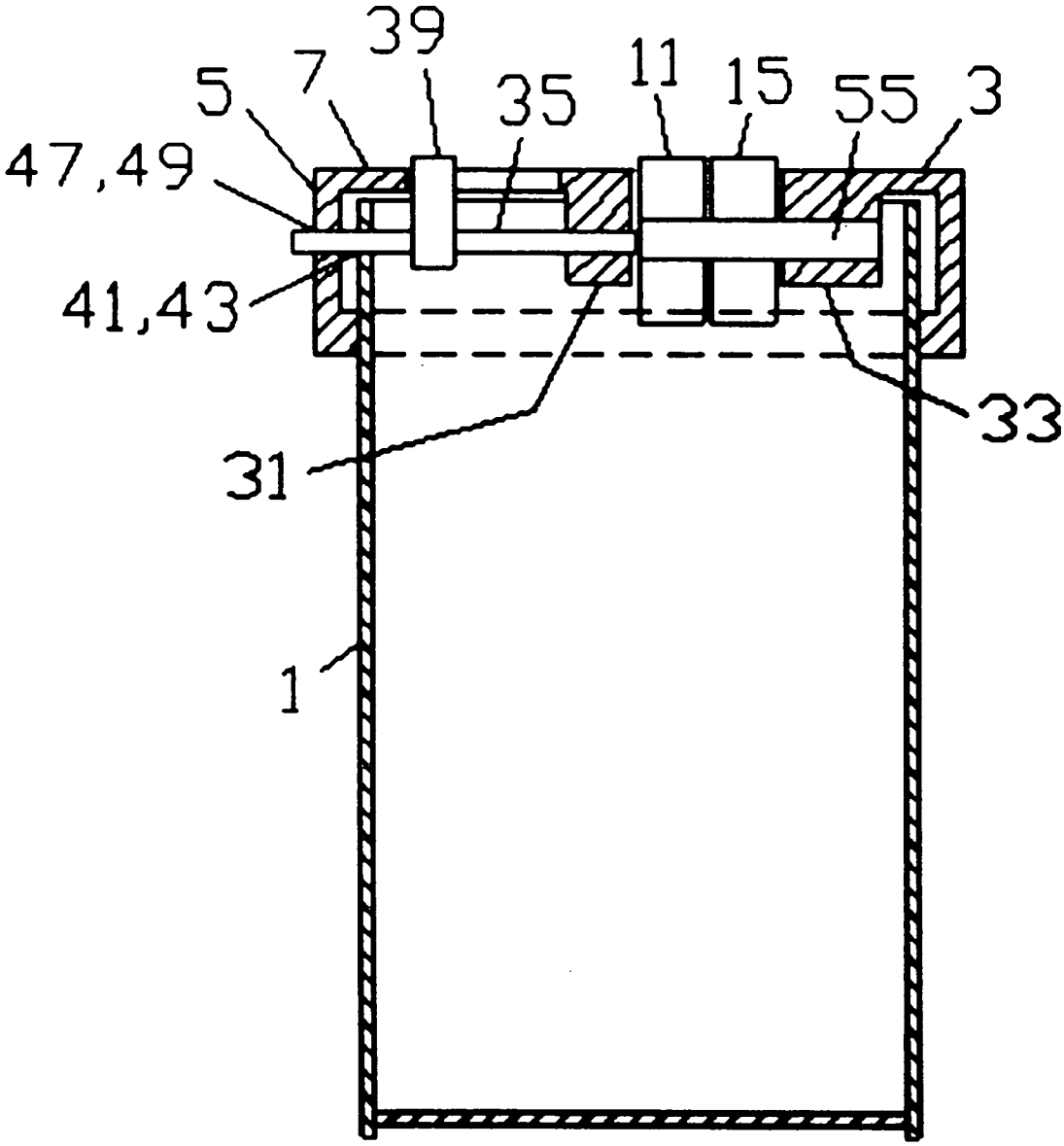
FIG. 3 is a second side elevation of a locking cap on a vial at 90° to FIG. 1.

FIG. 3 is a side elevation of FIG. 1 rotated 90° about the axis of the vial and cap. A bulkhead 31 crosses the cap slightly off center of the diameter. The bulkhead serves as a support for at least the axis for finger wheel 11 and as a guide for pins 35, 37. Pins 35, 37 are connected by bridge tab 39 projecting above top 7 and are supported by bulkhead 31 and penetrate holes 41, 43 in vial 1 and preferably enter holes 47, 49 in wall 5 of cap 3, when the cap is in the locked position. Thus, in carrying out the illustrated invention, there are provided one or more slideable pins 21, 23 having a projection 39 extending above the top of the cap 3.

Figure 4:
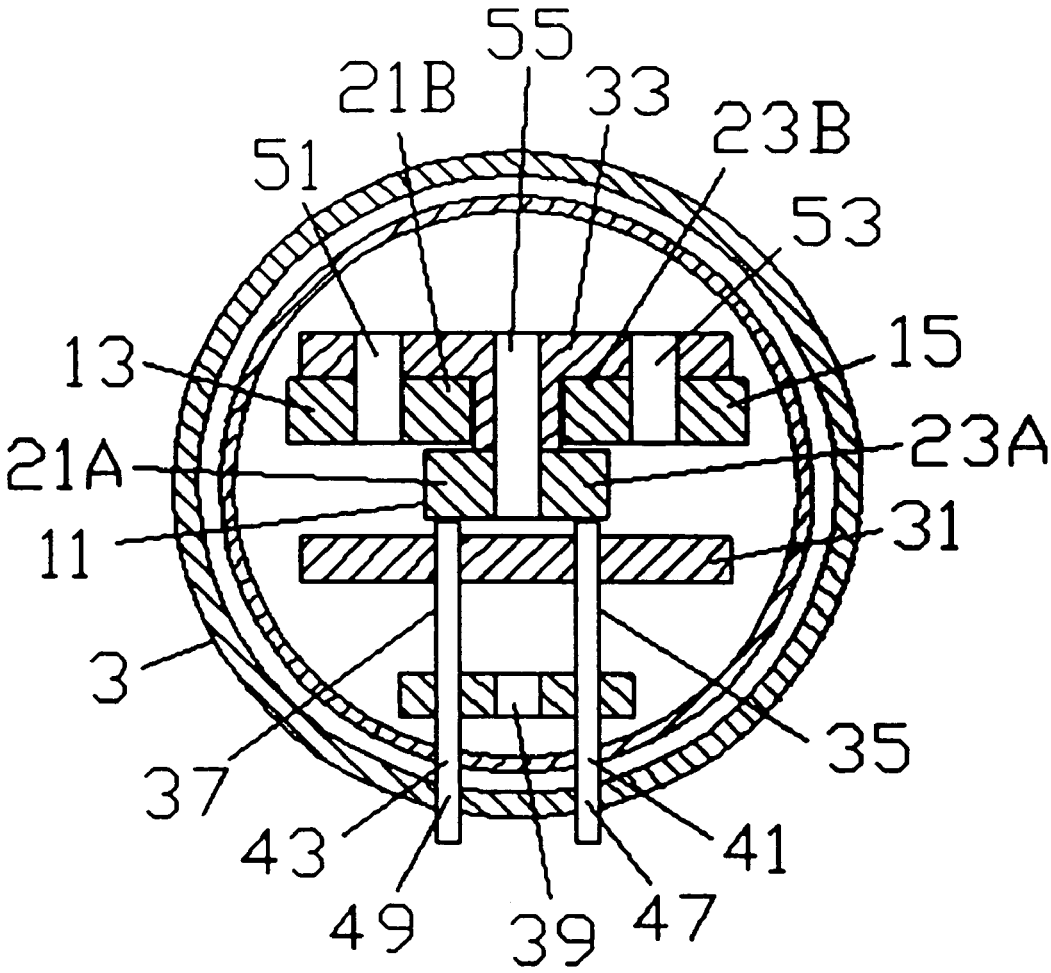
FIG. 4 is a view along lines A-A of FIG. 1 showing the cap and vial in the locked position.

FIG. 4 is a view along line A-A of FIG. 1, looking upward into the bottom of cap 3. Second bulkhead 33 is seen carrying the axles 51, 53 for wheels 13, 15 and optionally, axles 55 of wheel 11. Tab 39 is in the locked position nearest the perimeter of the cap and pins 35, 37 project through the vial at 41, 43 into the cap at 47, 49. Preferably, the pins project through the cap.

Figure 5:
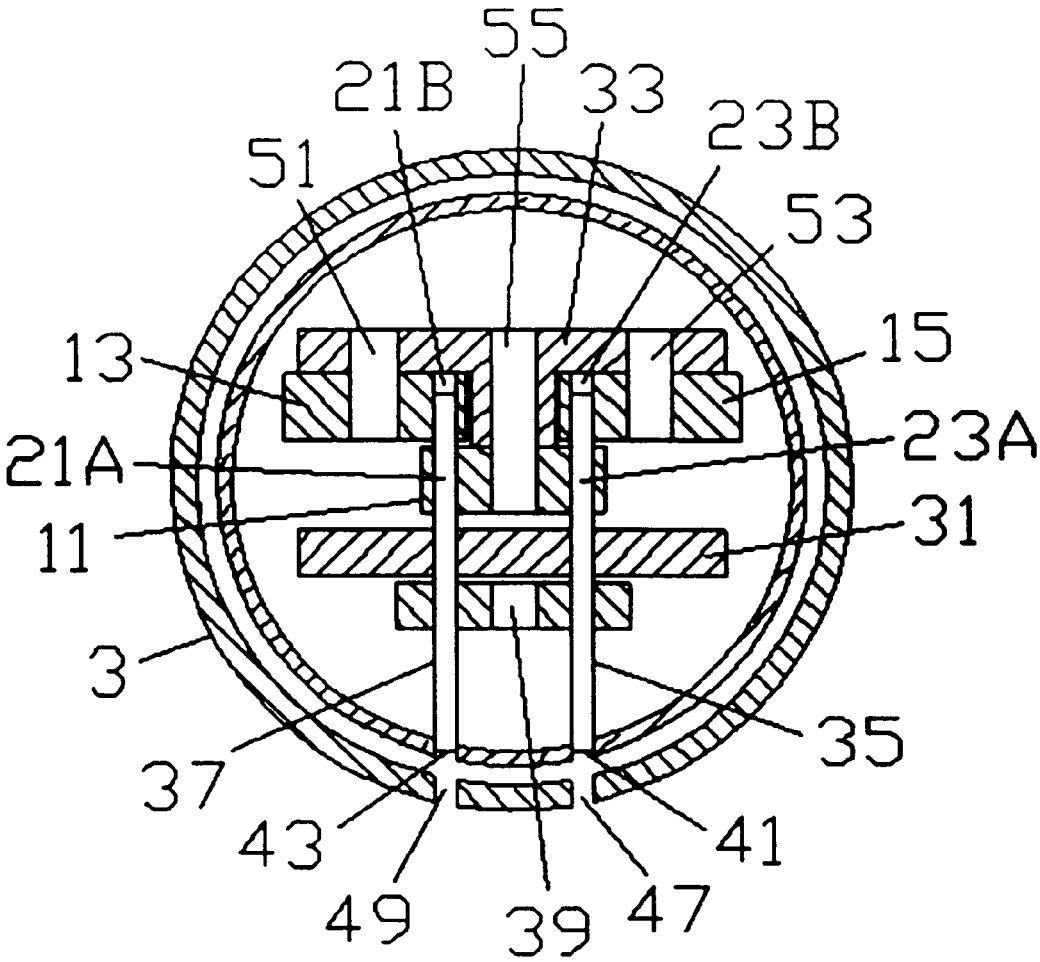
FIG. 5 is a view along lines A-A of FIG. 1 showing the cap and vial in the unlocked position.

FIG. 5 shows the cap in the unlocked position where 35, 37 pass through holes 21, 23 in wheels 11, 13, 15, thereby retracting 35, 37 from the cap and vial and freeing the cap to turn and be removed. Bulkhead 33 may or may not be relieved to accept pins 35, 37, depending upon the size of the vial and cap.

Optionally, a flange 61 on cap 3 may engage a flange on the vial (not shown) as is present on existing pharmacy vials.

Figure 6:
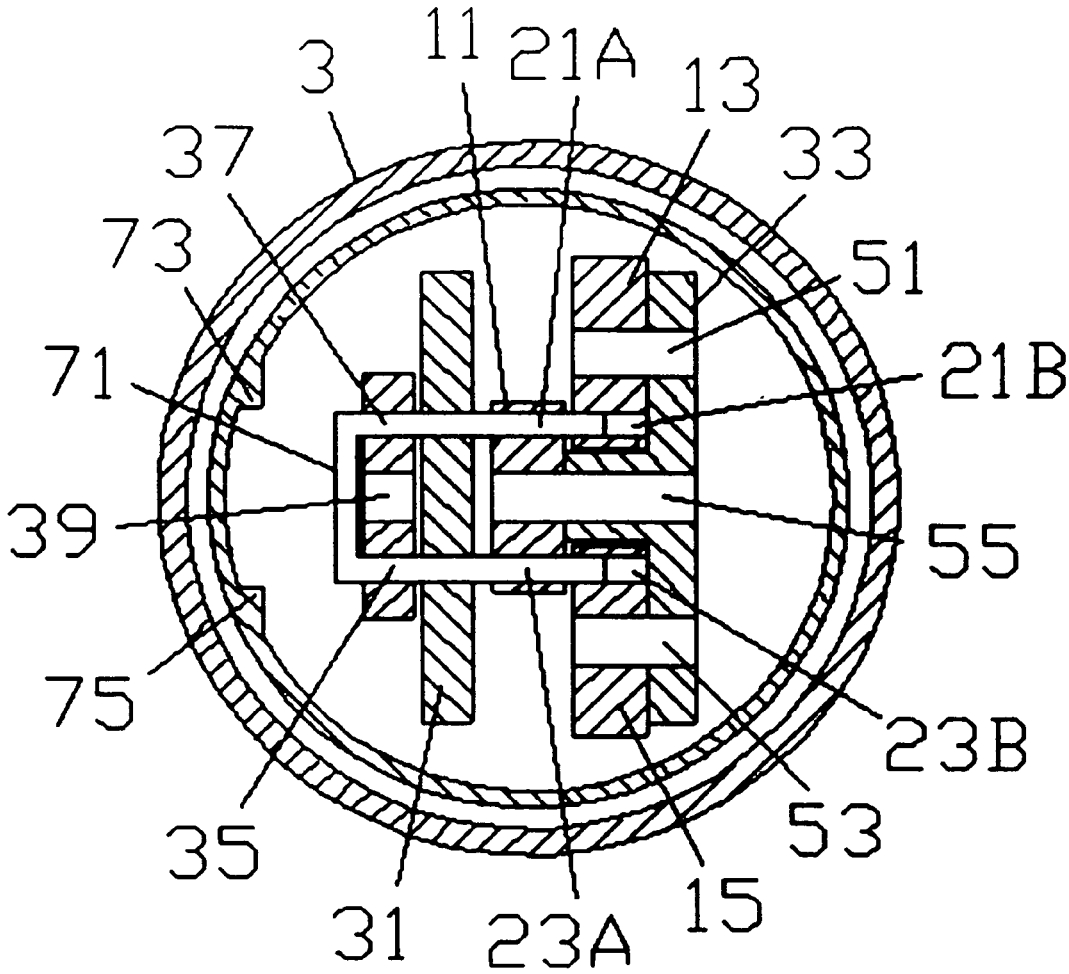
FIG. 6 is a view of the cap as seen from the bottom in a second embodiment of the invention.
Figure 7:
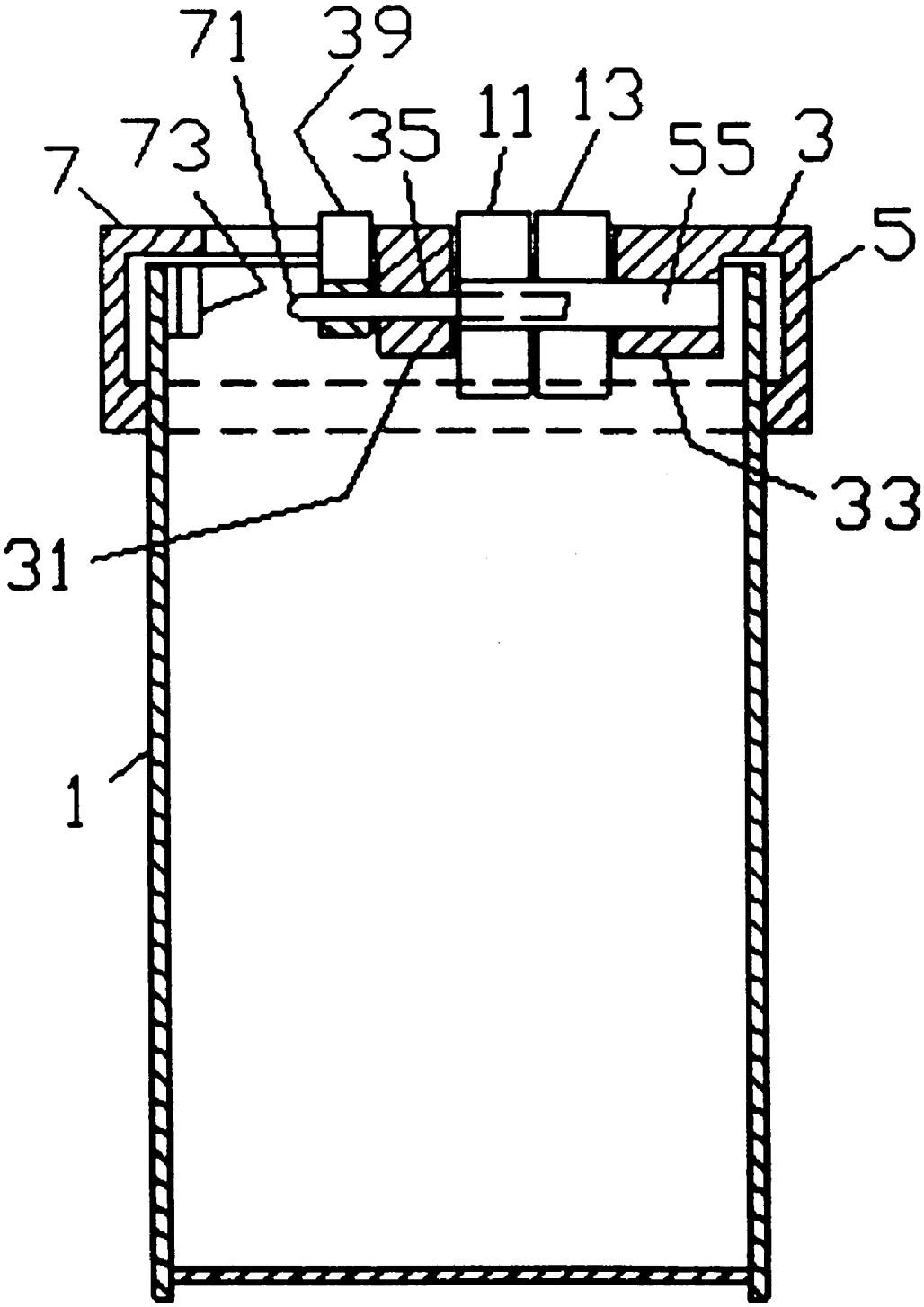
FIG. 7 is a side elevation of a second embodiment of the invention.

FIG. 6 is a view of the bottom of cap 3 in a second embodiment of the invention. In this embodiment it is not necessary to penetrate the vial or side of the top. Instead, pins 35, 37 connect to a single prong which engages the side of the vial. FIG. 7 is an elevation of the second embodiment.

Figure 8:
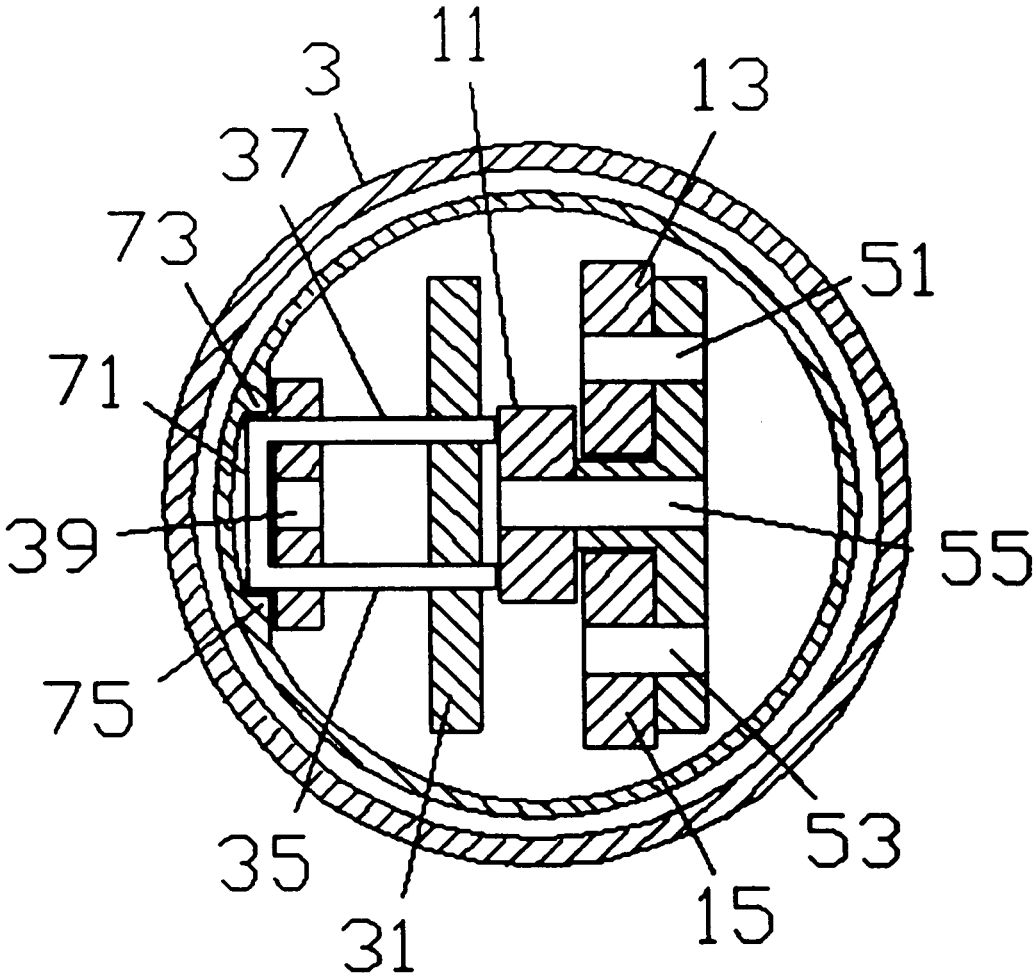
FIG. 8 is a view of a second embodiment in the locked position.
Figure 9:
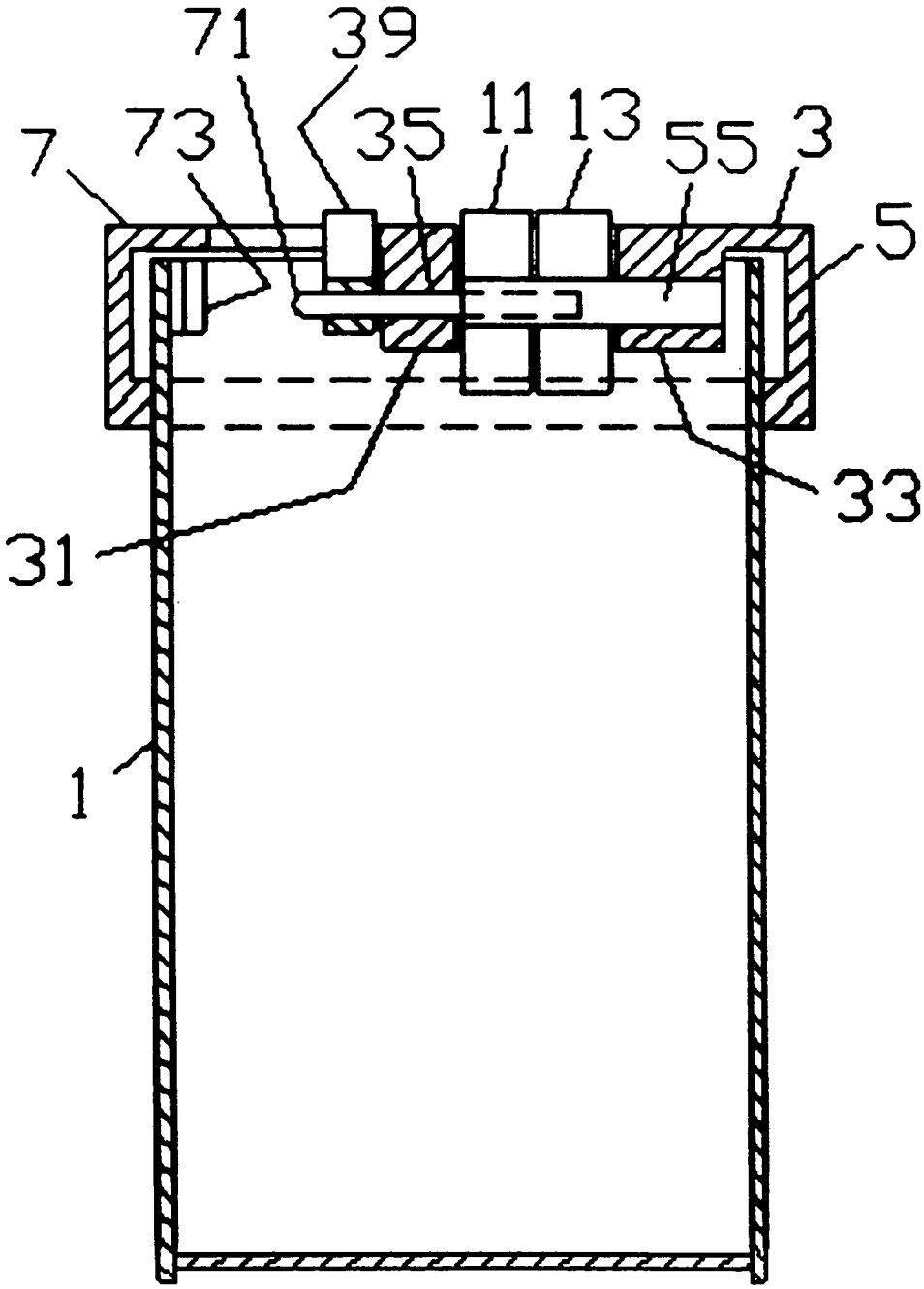
FIG. 9 is a view of a second embodiment in the unlocked position.
Figure 10:
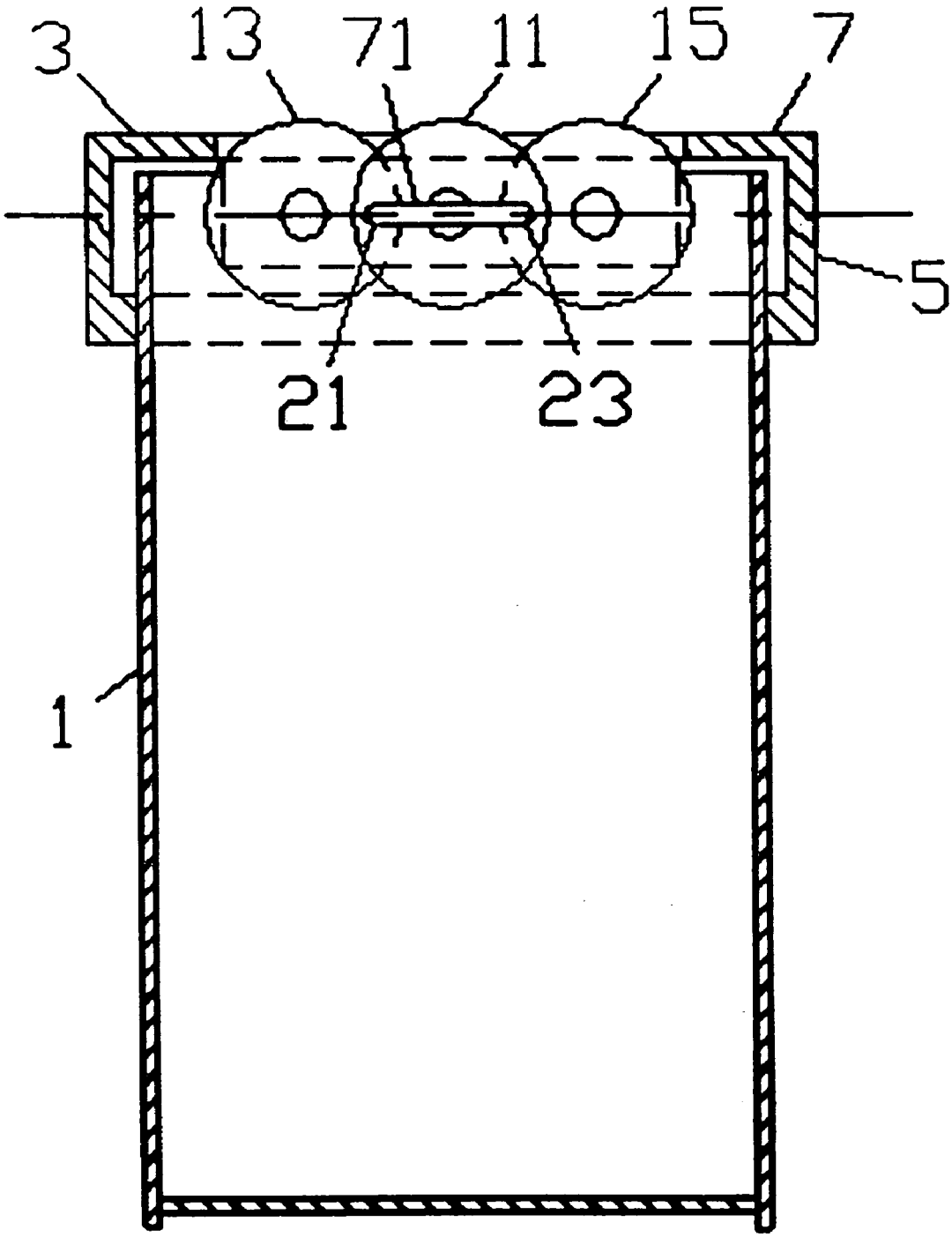
FIG. 10 is a side elevation of a second embodiment of the invention.
Figure 11:
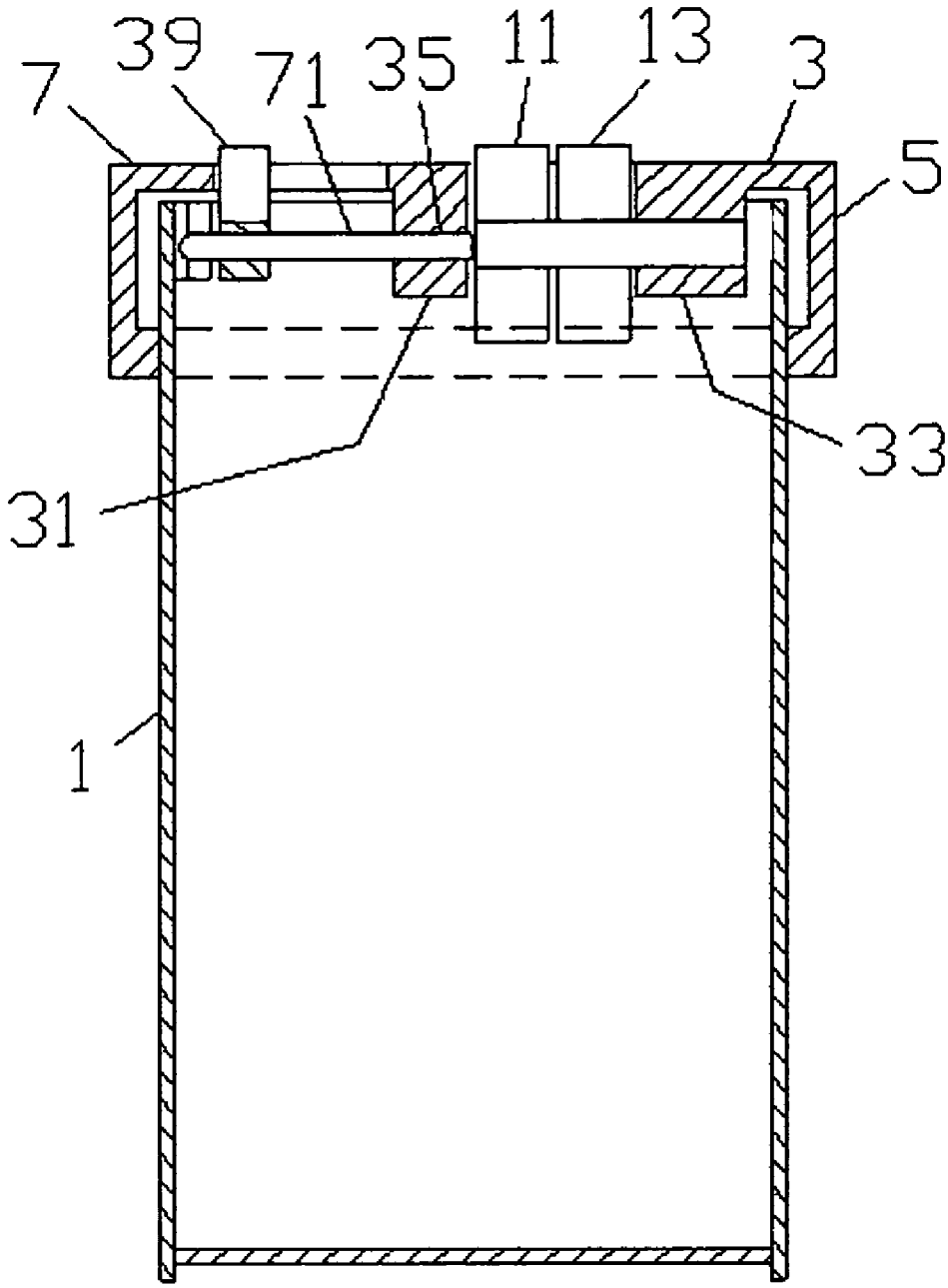
FIG. 11 is a side elevation of a second embodiment at 90° to the view in FIG. 10.

The second embodiment utilizes a crossbar 71 rigidly secured in bridging relation to the pins 35, 37. The inside of the vial carries two radially inward projecting abutments or projections 73, 75 forming a notch into which the braced pins 35, 37 project or extend in the locked position. In this embodiment, the cap 3 may be gasketed to effect a leak-resistant structure. FIG. 8 shows a second embodiment locked with pins 35, 37 extending into the notch between the abutments 73, 75. FIG. 9 shows the cap in the unlocked position. FIG. 10 is a side view head-on to the locking pins. FIG. 11 shows the view of FIG. 10 at 90° to show the cap.

Figure 12:
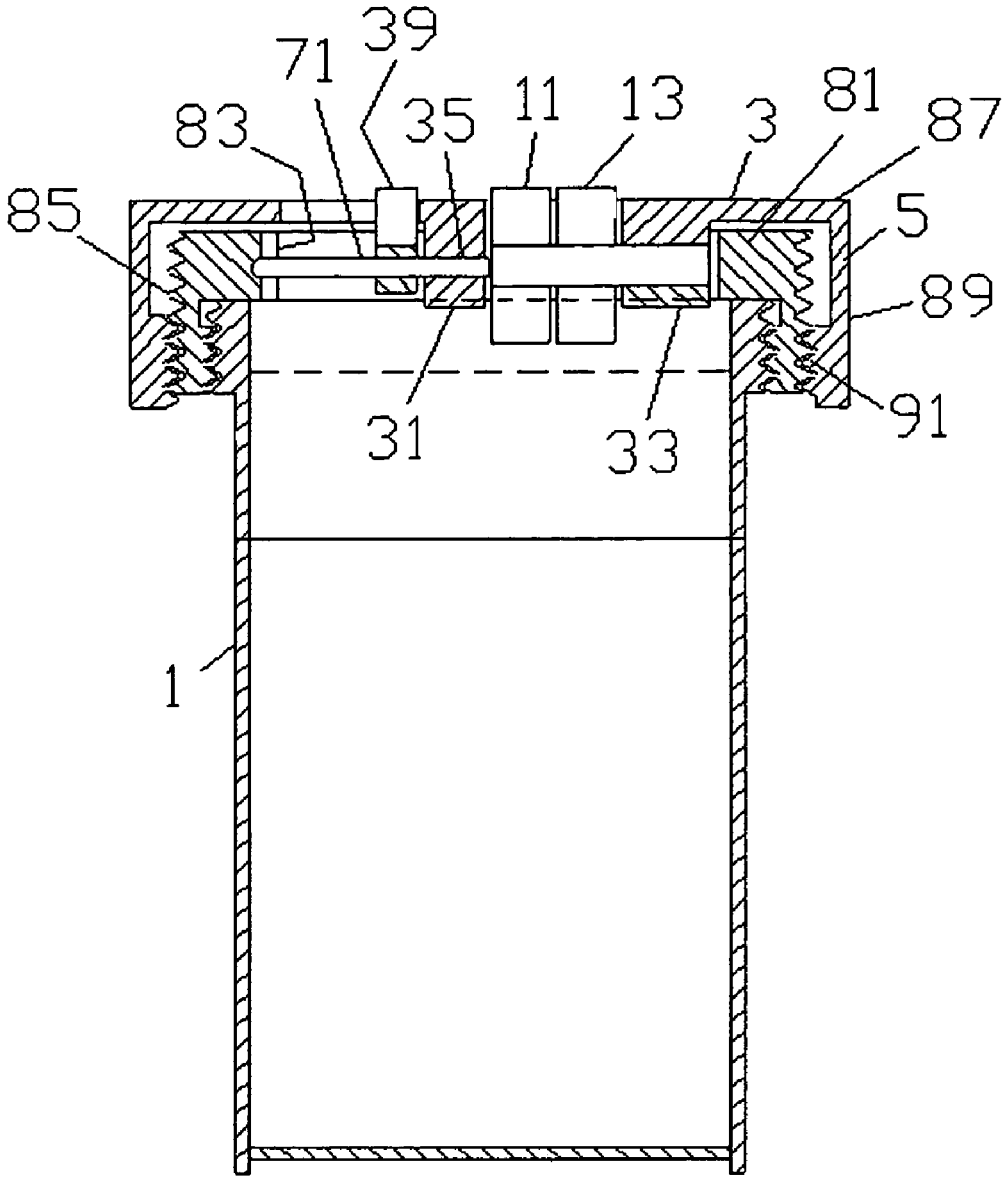
FIG. 12 is a side view of a third embodiment of the invention.
Figure 13:
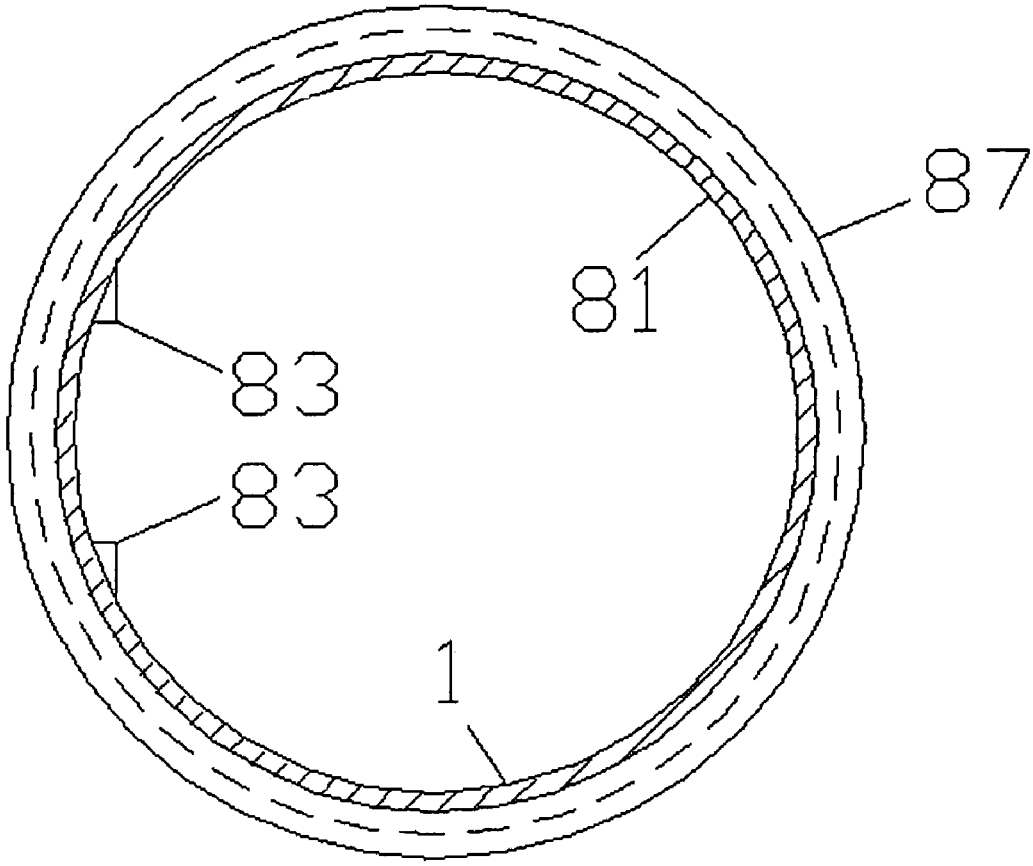
FIG. 13 is a plan view of a third embodiment of the invention.

Either embodiment may be adapted to be applied to any standard size vial or bottle using a screw or adaptor as shown in FIG. 12. The adaptor 81 is a topless cap having a right-handed 1 screw thread which is tightly applied to the top of the bottle. One or more projections 83 on the inside of the adaptor function in the same manner as the lock in FIGS. 8 and 9 (FIG. 13). On the outside of the adaptor are male thread 85 of a left-handed screw. Cap 87 has a skirt 89 having female threads 91 of a left-handed screw. Skirt 89 is sized to cover the sides of the adaptor in such a manner as to make it impossible to access the adaptor's sides by hand or with common hand tools. Opening the locked cap allows the capped bottle to be opened by turning clockwise. For complete security, the adaptor should be adhered to the bottle top with an adhesive such as an epoxy. The two-component epoxy may be applied separately or include two frangible capsules attached to the threads or top of the adaptor. Because the adhered adaptor becomes a part of the bottle, adaptors for standard threaded bottles may be sold separately.

The same concept may be used on drums of industrial chemicals by using a threaded insert for a bung-hole in a 55-gallon drum.

A bung plug normally has a bottom surface below the bottom of the drum top. The finger wheels of this invention may be used to lock and unlock pins which project below the bottom of the bung threads to prevent removal without retractions.

In applications for medicine vials and bottles, the cap may be made from a thermo formed plastic such as by injection molding. For larger applications, such as drums, tanks, etc., a mild steel may be more suitable.

Detents are not required form practice of this invention. When detents are desired, a leaf spring in sinesoidal configuration and having small dimples may be interleaved between the thumb wheels to engage small indentations in the front of thumb wheels 13, 15 and the back face of thumb wheel 11 to provide a more mechanical feel to the locking mechanism. For larger applications, a spring load of the pins may be desirable and may be biased in the locked or unlocked position.

Figure 14:
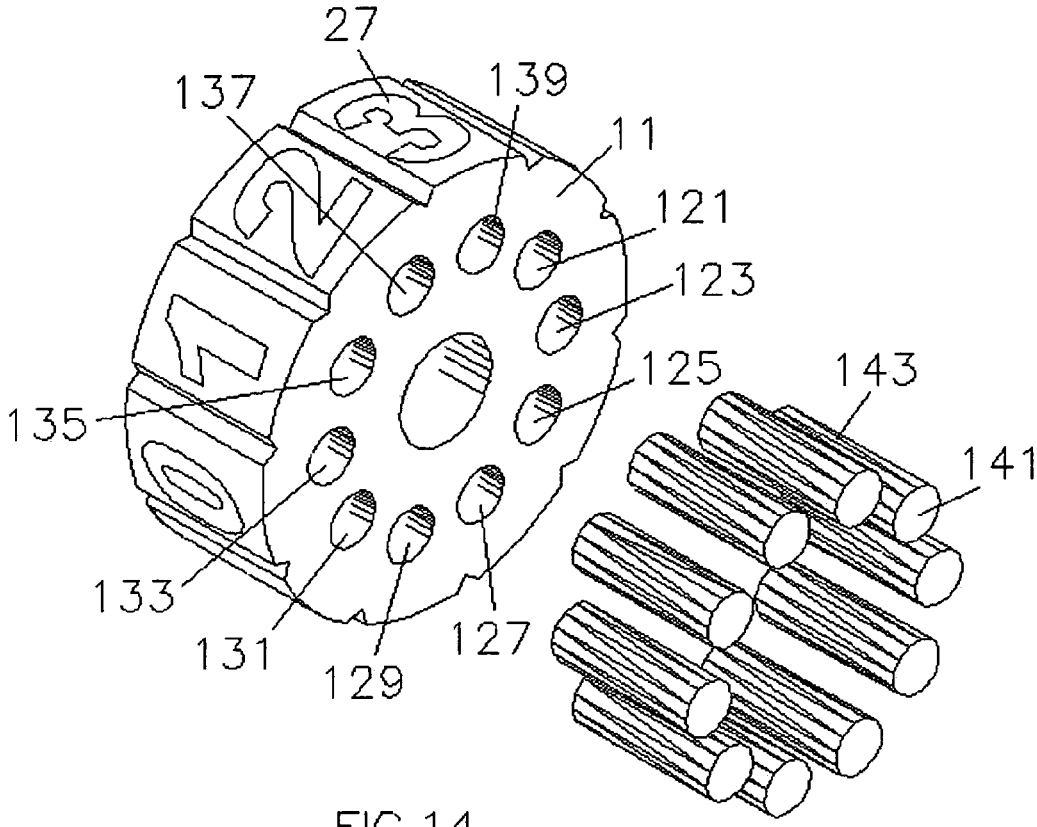
FIG. 14 shows how a combination can be set for thumb wheels using insertable pins.

Caps according to this invention may be purchased with preset combinations. Combinations can be reset by replacing one or more of the thumbwheels. Alternatively, thumb wheels could be purchased separately and the combination set at the point of purchase or by the purchaser. FIG. 14 shows a thumbwheel with ten bores corresponding to number locations 27. Pins 141 having suitable roughened surfaces 143 may be inserted to blank off undesired numbers and to set authorized combinations. Preferably, the same combination would be used on all caps used by each individual.

INDUSTRIAL UTILITY

The invention disclosed herein may be used for safe-keeping medicines and household chemicals such as cleaners, pesticides and paint thinners and to secure toxic industrial chemicals in transit or on-site.

The invention has been described in terms of preferred embodiments which do not limit the scope of the invention. Modifications and adaptation apparent to those skilled in the art are included within the spirit and cope of the invention.

The invention claimed is:

1. A locking cap for a container comprising:

a substantially flat top with a top surface, a downwardly projecting skirt, said skirt having an inner margin means in the form of a screw thread for engaging a container;

a plurality of rotatable thumb wheels rotatably mounted in said top on parallel axes, said thumb wheels having knurled surfaces and indicia on an outer surface and projecting at least in part above the surface of said top;

at least one hole through each of said plurality of thumb wheels which can be brought into alignment by rotation of said thumb wheels;

one or more pins slideably mounted to said top in alignment with and insertable into said holes when said holes are in alignment, said one or more pins engaging locking means in said container when withdrawn from said holes; and a tab rigidly secured to said one or more pins so as to project above said top surface of said top and to be engageable by a human hand for sliding said one or more pins.

2. A vial comprising:

a container having a cylindrical interior sidewall with a vertically extending cylindrical interior surface including a pair of circumferentially spaced and radially inward projecting abutments forming a notch near the upper end of said container, a cap having a substantially flat top and a downwardly projecting skirt, said skirt having an inner margin means for engaging a container;

a plurality of rotatable thumb wheels rotatably mounted on said top on parallel axes, said thumb wheels having knurled surfaces and indicia on an outer surface and projecting at least in part above said surface of said top, a hole through each of said plurality of thumb wheels which can be brought into alignment by rotation of said thumb wheels;

a pin slideably mounted to said top in alignment to pass into said holes when said holes are in alignment, said pin extending into said notch when withdrawn from said holes; and a tab secured to said pin and projecting above the surface of said top, said tab being engageable by a human hand for sliding said pin.

3. A locking cap for a container comprising:

a cap having a substantially flat top and a downwardly projecting skirt, said skirt having an inner margin means in the form of a screw thread for engaging a container;

a plurality of rotatable thumb wheels rotatably mounted on parallel axes in said top, said thumb wheels having knurled surfaces and indicia on an outer surface and projecting at least in part above the surface of said top;

at least one hole through each of said plurality of thumb wheels which can be brought into alignment by rotation of said thumb wheels;

a pin slideably mounted to said top in alignment to pass into said holes when said holes are in alignment, said pin engaging locking means in a container when withdrawn from said aligned holes; and a tab secured to said pin and projecting above the surface of said top for manual movement of said pin.

4. A cap according to claim 3 wherein said screw thread is a right-handed screw thread.

5. A cap according to claim 3 wherein said screw thread is a left-handed screw thread.

* * * * *